US010648650B1

(12) United States Patent
Tran et al.

(10) Patent No.: US 10,648,650 B1
(45) Date of Patent: May 12, 2020

(54) LIGHT FIXTURE ACCESSORY MOUNT

(71) Applicant: ABL IP Holding LLC, Atlanta, GA (US)

(72) Inventors: Albert Tran, Norcross, GA (US); Stephen Barry McCane, McDonough, GA (US); Forrest Starnes McCanless, Oxford, GA (US); Yan Rodriguez, Suwanee, GA (US); Ashwin Michaelraj, Peachtree City, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/168,158

(22) Filed: Oct. 23, 2018

(51) Int. Cl.

| | |
|---|---|
| ***F21V 17/16*** | (2006.01) |
| ***F21V 23/04*** | (2006.01) |
| ***F21V 17/12*** | (2006.01) |
| ***F21Y 115/10*** | (2016.01) |
| ***F21Y 103/10*** | (2016.01) |

(52) U.S. Cl.
CPC ..... *F21V 17/164* (2013.01); *F21V 17/12* (2013.01); *F21V 23/0435* (2013.01); *F21Y 2103/10* (2016.08); *F21Y 2115/10* (2016.08)

(58) Field of Classification Search
CPC .... F21S 4/28; F21S 4/22; F21V 23/02; F21V 23/006; F21V 23/06; F21V 17/164; F21V 17/12; F21V 23/0435; H05B 33/08; H05B 33/0821; H05B 33/0818; F21Y 2103/10; F21Y 2115/10; F21K 9/17
USPC ..... 362/221
See application file for complete search history.

(56) References Cited

U.S. PATENT DOCUMENTS

| | | | |
|---|---|---|---|
| 4,908,738 | A | 3/1990 | Kobari et al. |
| 5,221,209 | A | 6/1993 | D'Amico |
| 7,269,031 | B2 | 9/2007 | Lorenzen |
| 7,382,630 | B2 | 6/2008 | Lorenzen |
| 7,791,901 | B2 | 9/2010 | Sailor et al. |
| 7,848,116 | B2 | 12/2010 | Duppong et al. |
| 7,918,591 | B2 | 4/2011 | Lynch |
| 8,408,743 | B1 | 4/2013 | Chen et al. |
| 8,414,161 | B2 | 4/2013 | Holder et al. |
| 8,939,603 | B2 | 1/2015 | Huang et al. |
| 9,388,949 | B2 | 7/2016 | Holder et al. |
| 9,587,810 | B2 | 3/2017 | Parekh |
| 2009/0027858 | A1 | 1/2009 | Lai et al. |
| 2015/0009651 | A1 | 1/2015 | Lee |
| 2017/0175984 | A1 | 6/2017 | Parekh |

*Primary Examiner* — Joseph L Williams
*Assistant Examiner* — Jose M Diaz
(74) *Attorney, Agent, or Firm* — Kilpatrick Townsend & Stockton LLP

(57) ABSTRACT

A light fixture includes an electronic accessory module such as a wireless communication module, and a clip for mounting the accessory module to a panel of the light fixture. The clip includes features for snapping the accessory module to a panel of the light fixture, for example to a printed circuit board holding light emitting diodes or to a sheet metal panel that is part of the structure of the light fixture. The clip may hold the accessory module electronics away from any metal parts of the light fixture. In the case that the accessory module is a wireless communication module, this spacing may facilitate robust wireless communication.

18 Claims, 8 Drawing Sheets

LIGHT FIXTURE ACCESSORY MOUNT

BACKGROUND OF THE INVENTION

Besides providing light, some light fixtures include other capabilities. For example, some light fixtures include wireless communication circuitry such as a Bluetooth™ transceiver. The Bluetooth transceiver draws power from the same source as is used to power the light fixture, and interfaces with a driver circuit, providing additional capabilities to the light fixture. For example, the light fixture may be controlled from a Bluetooth™-enabled mobile device such as a mobile telephone running an appropriate application program. A user of the mobile device may be able to turn the light fixture off and on, change the brightness of the light emitted by the fixture, change the color of the light emitted by the light fixture, or control the light fixture in other ways.

The mounting of the wireless communication circuitry is subject to several constraints, and improvements in mounting techniques are desired.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings, and each claim.

According to a first aspect, a light fixture comprises one or more light sources, an accessory module comprising circuit components mounted on a printed circuit board of the accessory module, and a clip for mounting the electronic accessory module to a panel of the light fixture. The clip comprises a body having top and bottom major surfaces, and a plurality of standoffs protruding from the top major surface. Each of the standoffs includes a support surface spaced above the top major surface of the clip. The clip further comprises a plurality of upper spring clips protruding above the top major surface, each of the upper spring clips including a column and a hook feature on the column. The vertical distance between the support surfaces of the standoffs and the bottoms of the hook features of the upper spring clips is sized to accommodate the thickness of the printed circuit board of the accessory module such that the hook features of the upper spring clips engage edges of the printed circuit board of the accessory module and constrain the printed circuit board of the accessory module over the support surfaces. The clip further comprises a plurality of lower spring clips protruding below the bottom major surface of the clip, each of the lower spring clips including a column and a hook feature. The vertical distance between the bottom major surface and the hook features of the lower spring clips is sized to accommodate the thickness of the panel of the light fixture, and wherein the lower spring clips engage the panel and constrain the clip to the panel.

According to another aspect, a method of assembling a light fixture comprises providing a light fixture having a panel defining a plurality of openings, providing an accessory module for the light fixture, the accessory module comprising circuit components mounted on a printed circuit board of the accessory module, and providing a clip. The clip comprises a body having top and bottom major surfaces, and a plurality of standoffs protruding from the top major surface, each of the standoffs including a support surface spaced above the top major surface of the clip. The clip further comprises a plurality of upper spring clips protruding above the top major surface, each of the upper spring clips including a column and a hook feature on the column, wherein the vertical distance between the support surfaces of the standoffs and the bottoms of the hook features of the upper spring clips is sized to accommodate the thickness of the printed circuit board of the accessory module such that the hook features of the upper spring clips engage edges of the printed circuit board of the accessory module and constrain the printed circuit board of the accessory module over the support surfaces. The clip further comprises a plurality of lower spring clips protruding below the bottom major surface of the clip, each of the lower spring clips including a column and a hook feature, wherein the vertical distance between the bottom major surface and the hook features of the lower spring clips is sized to accommodate the thickness of the panel of the light fixture, and wherein the lower spring clips engage the panel and constrain the clip to the panel. The method further comprises snapping the printed circuit board of the accessory module into the clip, and snapping the clip into the panel.

According to another aspect, a clip for mounting an accessory module to a panel of a light fixture comprises a body having top and bottom major surfaces, and a plurality of stepped standoffs protruding from the top major surface. Each of the stepped standoffs includes a support surface spaced above the top major surface of the clip, and each of the stepped standoffs includes a locating pin extending above the respective support surface. The clip further comprises a plurality of upper spring clips protruding above the top major surface. Each of the upper spring clips includes a column and a hook feature on the column. The vertical distance between the support surfaces of the standoffs and the bottoms of the hook features of the upper spring clips is sized to accommodate the thickness of a printed circuit board of the accessory module such that the hook features of the upper spring clips are configured to engage edges of the printed circuit board of the accessory module and constrain the printed circuit board of the accessory module over the support surfaces while the locating pins protrude into holes in the printed circuit board of the accessory module. The clip further comprises a plurality of lower spring clips protruding below the bottom major surface of the clip. Each of the lower spring clips includes a column and a hook feature. The vertical distance between the bottom major surface and the hook features of the lower spring clips is sized to accommodate the thickness of the panel of the light fixture, and the lower spring clips are configured to engage the panel and constrain the clip to the panel.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
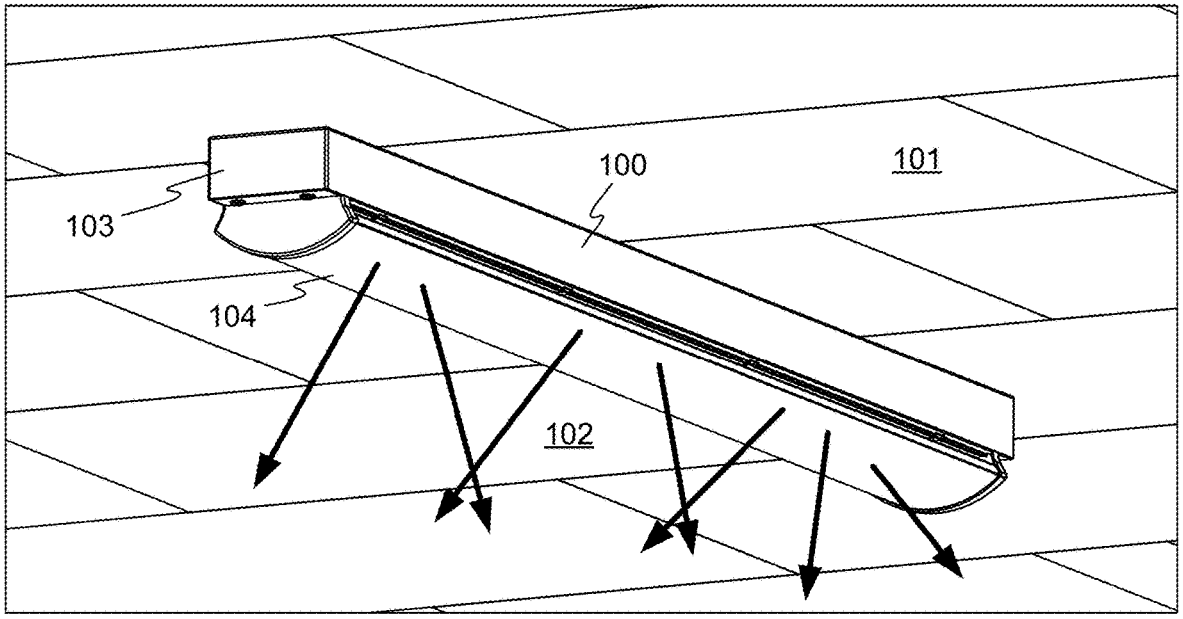
FIG. 1 depicts an example light fixture, in accordance with embodiments of the invention.

FIG. 1 depicts an example overhead light fixture 100, in accordance with embodiments of the invention. The light fixture 100 is of the type that may be mounted to or suspended from a ceiling 101, although it will be recognized that the invention may be embodied in other kinds of light fixtures as well.

The light fixture 100 produces light 102 for lighting a room or other space. The light fixture 100 includes a housing 103 holding driver and other electronics (not visible in FIG. 1), and a diffuser 104 for spreading the light emitted from the light fixture 100.

Figure 2:
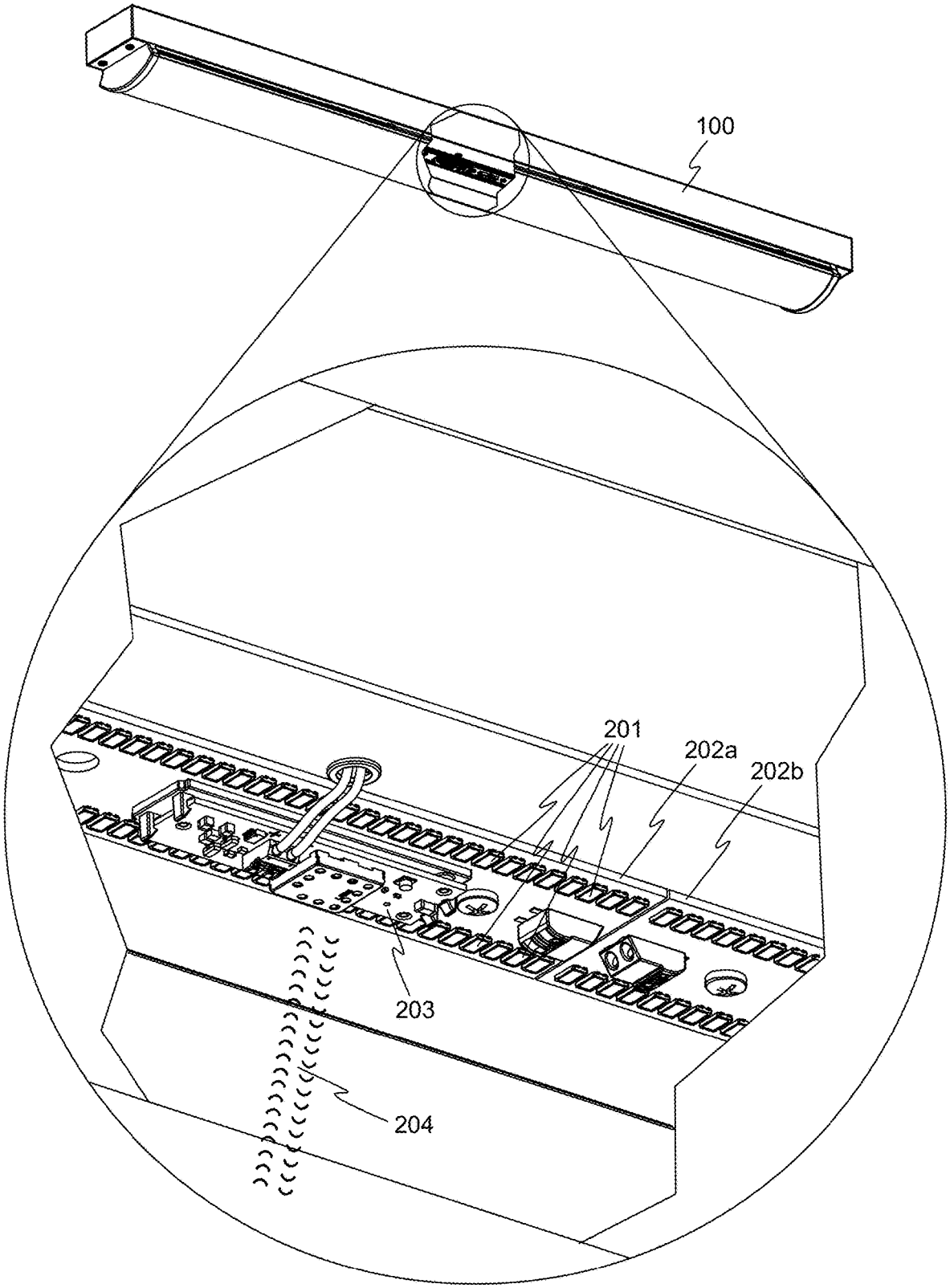
FIG. 2 illustrates a cutaway detail view of the light fixture of FIG. 1, including an accessory module and a printed circuit board.

FIG. 2 illustrates a cutaway detail view of the light fixture 100, revealing additional details of the inner structure of the light fixture 100. Although other architectures are possible, the light fixture 100 includes a number of light emitting diodes (LEDs) 201 arranged in two parallel rows on one or more printed circuit boards such as circuit boards 202*a* and 202*b*. The rows of LEDs 201 may extend substantially the entire length of the light fixture 100, and the LEDs 201 produce the light emitted by the light fixture 100.

The light fixture 100 also includes an accessory module 203, which in this example includes wireless communication circuitry such as a Bluetooth™ transceiver. The light fixture 100 is thus able to communicate wirelessly with similarly-equipped nearby devices, for example Bluetooth™-equipped mobile telephones, other light fixtures, or other devices. The light fixture 100 may include a controller that can adjust the operation of the light fixture in response to communications received via the accessory module, for example to change the brightness or color of the light emitted by the light fixture.

Figure 3:
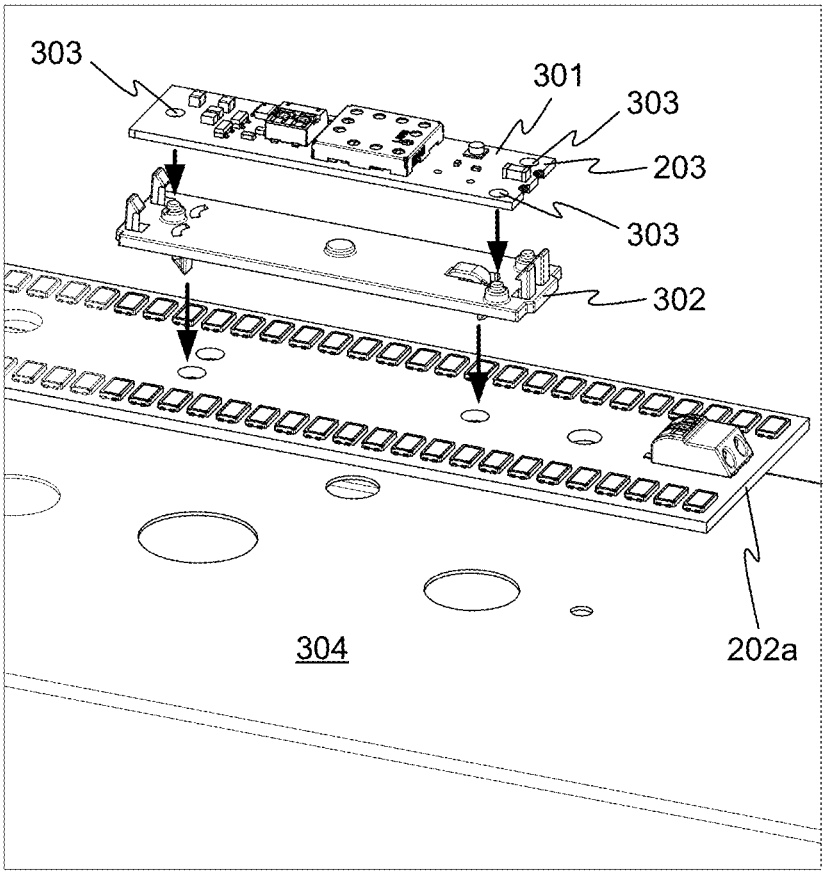
FIG. 3 shows the mounting of an accessory module into the light fixture of FIG. 1, in accordance with embodiments of the invention.

FIG. 3 illustrates the mounting of the accessory module 203 into the light fixture 100, in accordance with embodiments of the invention. The elements shown in FIG. 3 are inverted from their orientation in FIG. 2, for ease of illustration. The accessory module 203 includes its own printed circuit board 301, on which electronic components are mounted. The printed circuit board 301 snaps into a clip 302, which in turn snaps into the printed circuit board 201*a*. The circuit board 201*a* may be attached via screws or other fasteners to a sheet metal panel 304 that is part of the structure of the light fixture 100.

Figure 4:
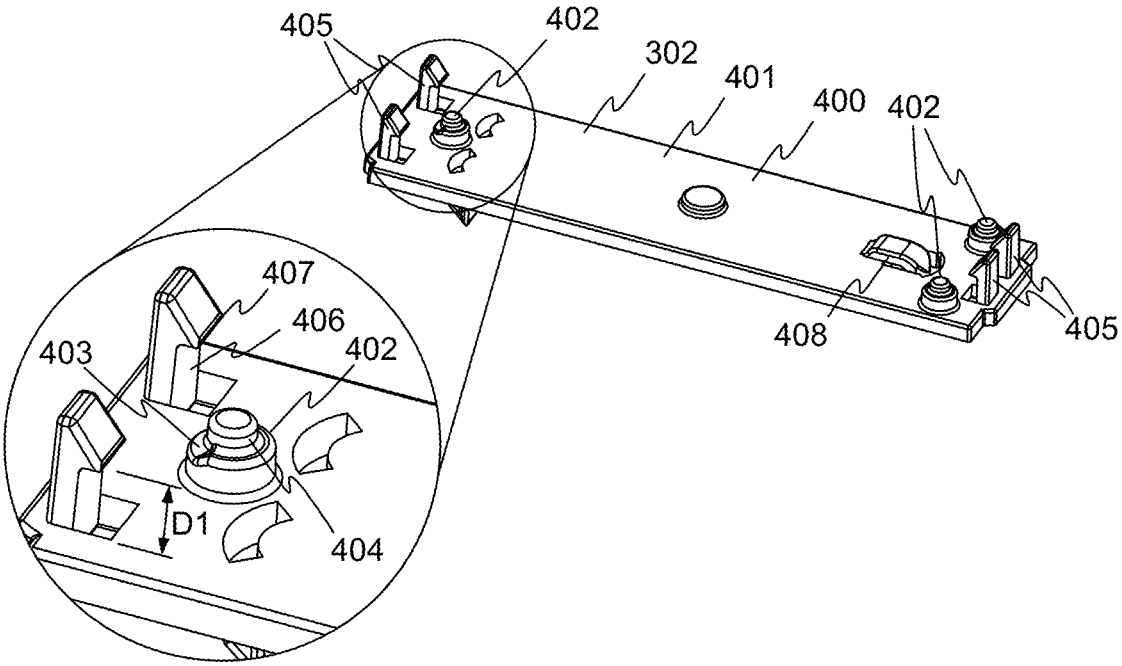
FIG. 4 shows an upper perspective view of the clip of FIG. 3.
Figure 5:
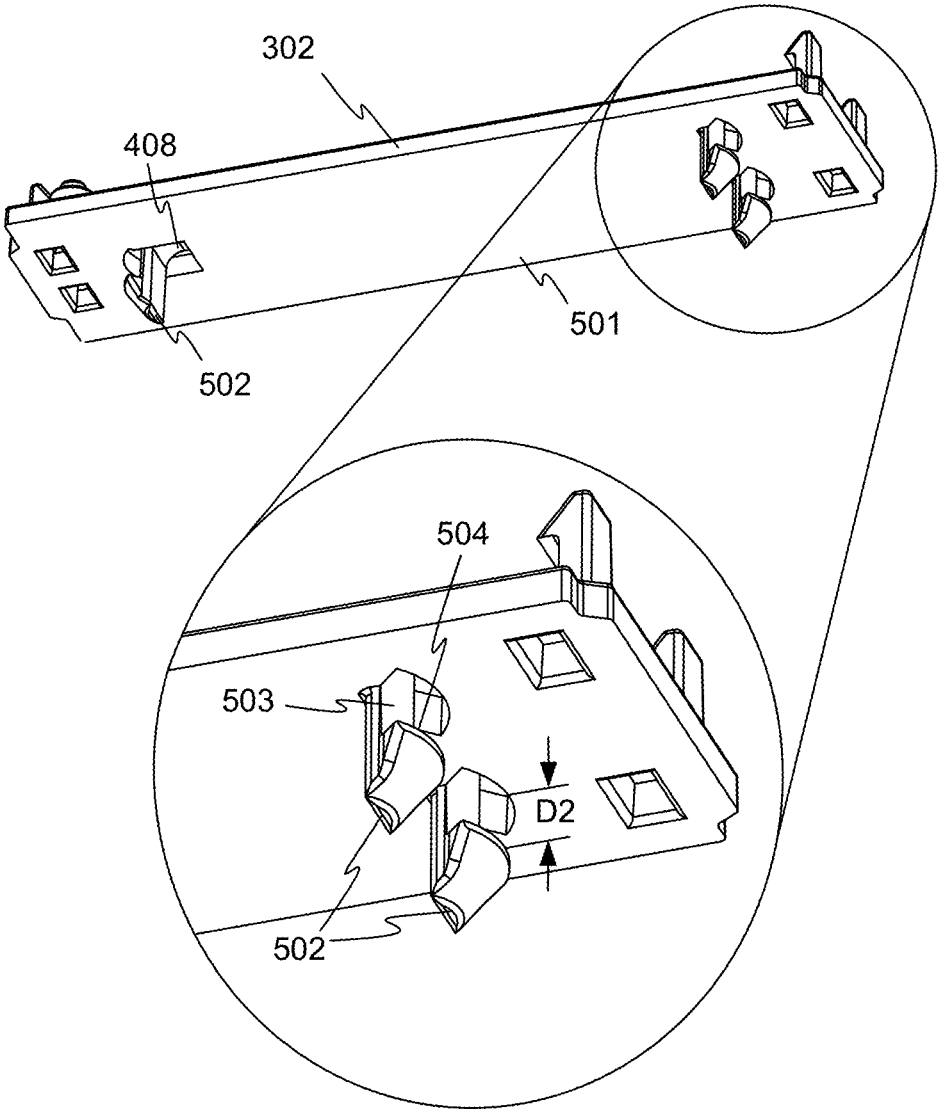
FIG. 5 shows a lower perspective view of the clip of FIG. 3.

FIG. 4 and FIG. 5 show upper and lower perspective views respectively of the clip 302. For the purposes of this disclosure, the terms "top", "bottom", "upper", and "lower" are used in relation to the orientation shown in FIG. 3. That is, the "upper" side of the clip 302 is away from the printed circuit board 202*a*, and the "lower" side of the clip 302 is disposed toward the printed circuit board 202*a*. These terms are not otherwise limiting. The accessory module 203 may be mounted in other orientations in relation to the light fixture 100, and the light fixture 100 may be used in any orientation.

Referring to FIGS. 3-5, the clip 302 has a body 400 having a top major surface 401 and a bottom major surface 501. A number of stepped standoffs 402 protrude from the top major surface 401 of the clip 302. Each of the stepped standoffs 402 includes a support surface 403 spaced above the top major surface 401 of the clip 302, and a locating pin 404 extending above the support surface 403.

A number of upper spring clips 405 also protrude above the top major surface 401. Each of the upper spring clips 405 includes a column 406 and a hook feature 407 on the column 406. Column 406 on at least one of the upper spring clips 405 may be flexible. The vertical distance D1 between support surfaces 403 of the standoffs 402 and the bottoms of the hook features 407 is sized to accommodate the thickness of the circuit board 301. The circuit board 301 can thus be snapped into the clip 302, such that the hook features 407 engage edges of the circuit board 301, constraining the circuit board 301 over the support surfaces 403, while the locating pins 404 protrude into holes 303 in the circuit board 301, as is shown in FIG. 2.

Referring again to FIGS. 3-5, the clip 302 also includes a number of lower spring clips 502 protruding below the bottom major surface 501 of the clip 302. Each of the lower spring clips 502 includes a column 503 and a hook feature 504. Column 503 on at least one of the lower spring clips 502 may be flexible. In some embodiments, one or more of the lower spring clips 502 may include a flexible lever arm 408. The flexible lever arm 408 may bend more easily so that a lower spring clip 502 may flex more readily than any of the lower spring clips 502 lacking flexible lever arms. The vertical distance D2 between the bottom major surface 501 and the lower hook features 504 is sized to accommodate the thickness of a panel of the light fixture 100, such that the lower hook features 504 engage edges of the panel, constraining the clip 302 to the panel. In this example, the panel is the circuit board 202*a* of the light fixture 100, as shown in FIG. 3.

Figure 6:
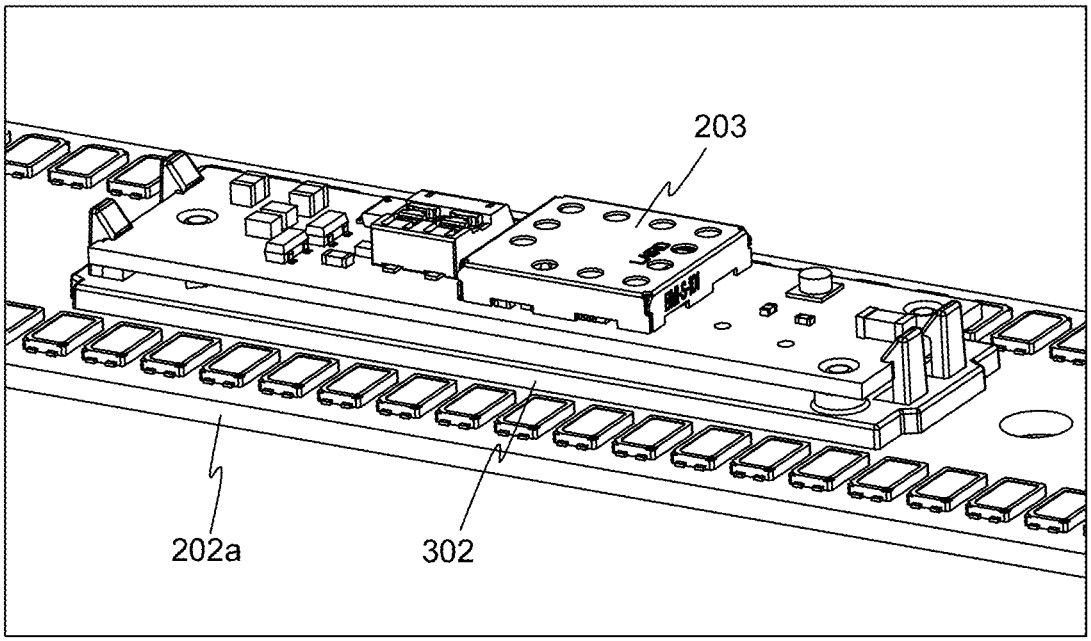
FIG. 6 illustrates an upper perspective view of the completed attachment of the accessory module of FIG. 2 to the printed circuit board of the light fixture, in accordance with embodiments of the invention.
Figure 7:
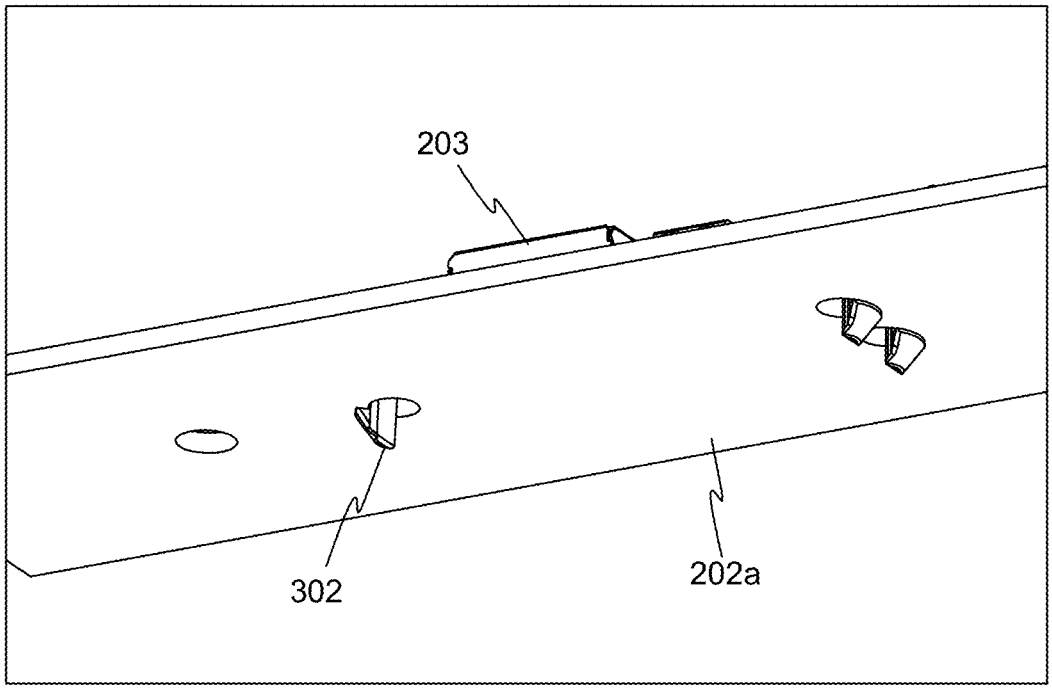
FIG. 7 illustrates a lower perspective view of the completed attachment of the accessory module of FIG. 2 to the printed circuit board of the light fixture, in accordance with embodiments of the invention.

FIG. 6 and FIG. 7 illustrate upper and lower perspective views respectively of the completed attachment of the accessory module 203 to the circuit board 202*a* using the clip 302.

The example arrangement FIGS. 2-7 described above may have one or more advantages. For example, positioning the clip 302 and accessory module 203 between the rows of LEDs 201 utilizes printed circuit board space that would otherwise be unoccupied. Thus, the addition of the accessory module 203 does not add to the size of the light fixture 100.

Figure 8:
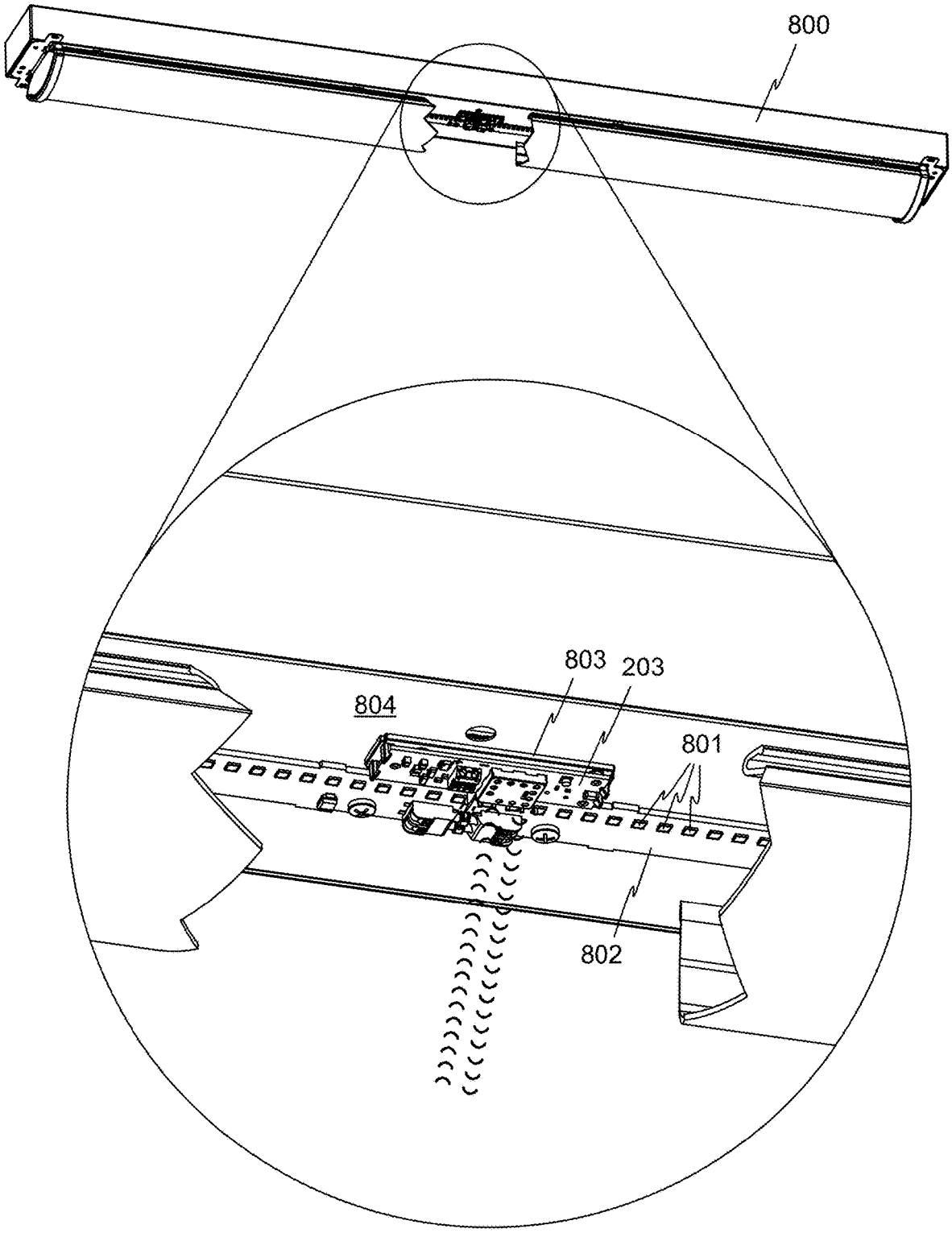
FIG. 8 illustrates a light fixture, including a clip and a printed circuit board, in accordance with other embodiments of the invention.

FIG. 8 illustrates a light fixture 800 in accordance with other embodiments of the invention. In this embodiment, only one row of LEDs 801 is present on a printed circuit board 802. Thus, it is desirable to position the accessory module 203 adjacent to the printed circuit board 802 rather than on it, so that the printed circuit board 802 does not have to be artificially widened and extra cost occurred. In this embodiment, a clip 803 is configured to clip the accessory module 203 directly to a metal panel 804 of the light fixture 800.

Figure 9:
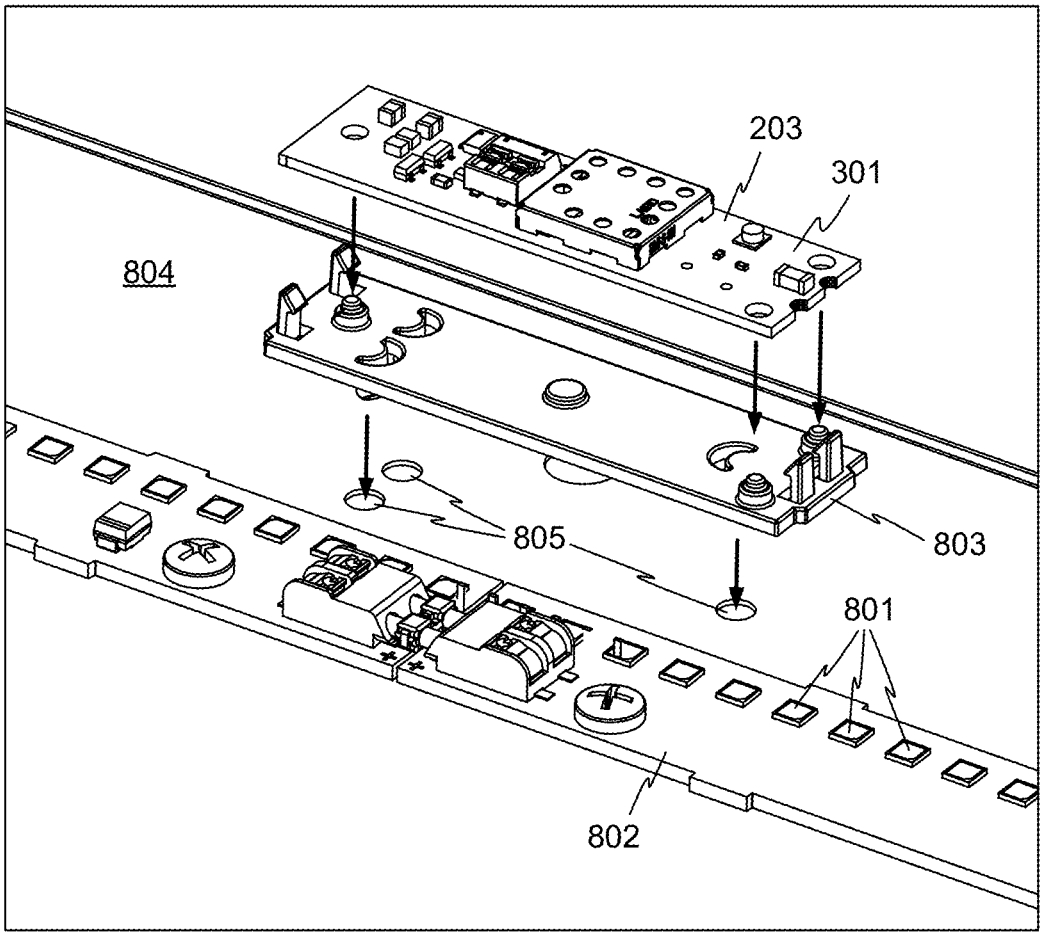
FIG. 9 illustrates the mounting of the accessory module of FIG. 2 into the light fixture of FIG. 8, in accordance with embodiments of the invention.

FIG. 9 illustrates the mounting of the accessory module 203 into the light fixture 800, in accordance with embodiments of the invention. The elements shown in FIG. 9 are inverted form their orientation in FIG. 8, for ease of illustration. The accessory module 203 includes its own printed circuit board 301, on which electronic components are mounted. The printed circuit board 301 snaps into the clip 803, which in turn snaps into the metal panel 804, via holes 805.

Figure 10:
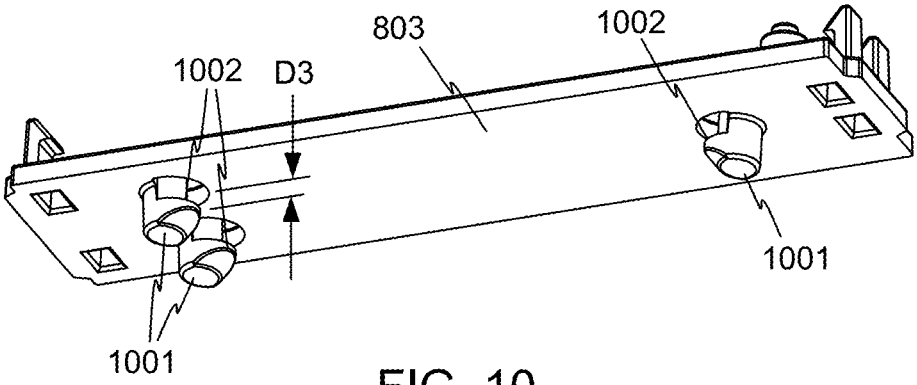
FIG. 10 illustrates a lower perspective view of the clip of FIG. 8, in accordance with embodiments of the invention.

FIG. 10 illustrates a lower perspective view of the clip 803, in accordance with embodiments of the invention, and illustrates an alternative arrangement of lower spring clips 1001. In this embodiment, hook features 1002 of lower spring clips 1001 extend inward toward the center of the clip 803 (rather than outward as in the clip 302). In addition, the distance D3 is somewhat smaller than in clip 302, because the metal panel 804 is thinner than the circuit board 202*a*. The distance D3 may be selected in accordance with the thickness of the panel into which a clip is to be mounted. In other embodiments, a single clip configuration may be usable on panels of different thicknesses, so long as the distance D3 is sufficient to receive the intended panel.

Figure 11:
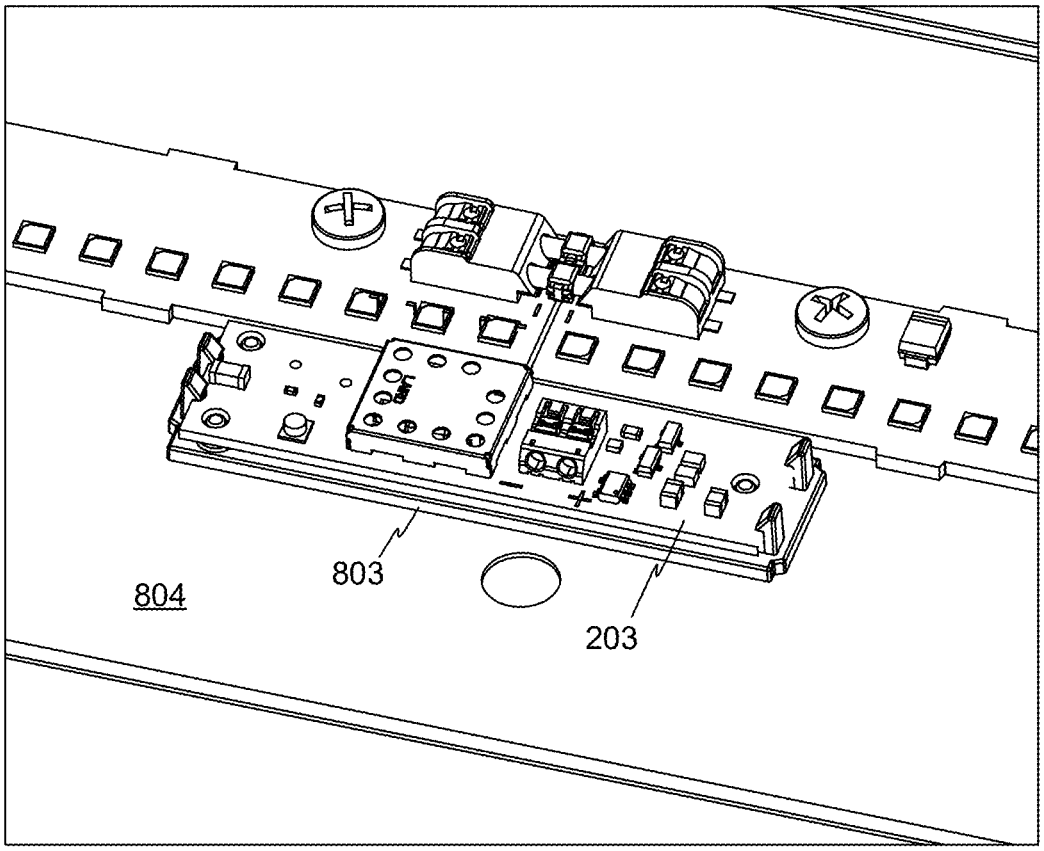
FIG. 11 illustrates an upper perspective view of the completed attachment of the accessory module of FIG. 2 to the circuit board of FIG. 8, using the clip of FIG. 9, in accordance with embodiments of the invention.
Figure 12:
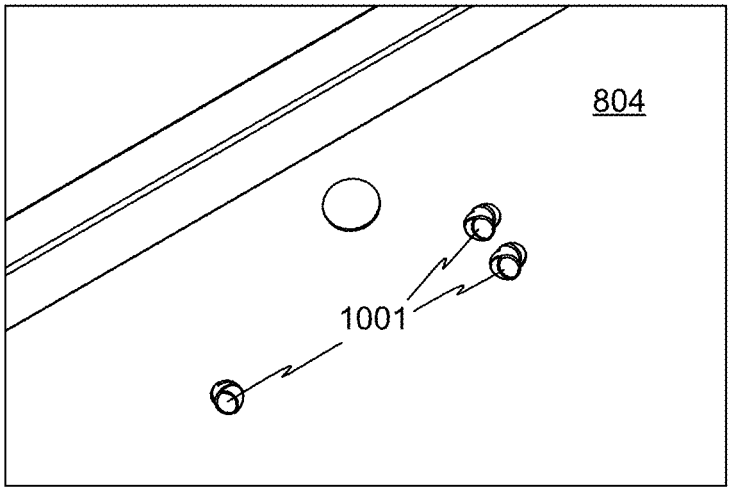
FIG. 12 illustrates a lower perspective view of the completed attachment of the accessory module of FIG. 2 to the circuit board of FIG. 8, using the clip of FIG. 9, in accordance with embodiments of the invention.

FIG. 11 and FIG. 12 illustrate upper and lower perspective views respectively of the completed attachment of the accessory module 203 to the circuit board 802 using the clip 803. The accessory module The mounting arrangements of the above embodiments position the accessory module 203 with good exposure to the space lighted by the light fixture 100, so that wireless communication is not obstructed or distorted by any metal parts of the light fixture 100. For example, wireless communication may only need to pass through the diffuser 104 (shown in FIG. 1), which may be essentially transparent to electromagnetic signals. In addition, the clip 302 or 803 may space the accessory module 203 away from any underlying metallic surfaces, to further facilitate good wireless communication performance. This spacing may alleviate or at least minimize the problem that metallic elements disposed too closely to a wireless communication antenna can cause distortion of the field of coverage of signals emitted by the antenna, and thus inconsistent communication coverage in the vicinity of the antenna. Preferably, a clip such as the clip 302 or the clip 803 spaces the printed circuit board of the accessory module 203 at least 2.0 millimeters from any metal panel, and preferably at least 2.5 millimeters, and more preferably at least 3.0 millimeters.

A clip in accordance with embodiments of the invention is preferably made as a monolithic part molded from a polymer, for example, ABS, polycarbonate, or another suitable polymer or a blend of polymers, to avoid interference with wireless communications to and from the accessory module 203. The material of the clip may include various additives if desired, for example glass fibers to increase the stiffness and strength of the material. In other embodiments, a clip in accordance with embodiments of the invention may be assembled from multiple parts. For example, the locating pins 404 may be pressed into the remainder of the clip.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents. It is to be understood that any workable combination of the features and capabilities disclosed herein is also considered to be disclosed.

What is claimed is:

1. A light fixture, comprising:

one or more light sources;

an accessory module comprising circuit components mounted on a printed circuit board of the accessory module; and a clip for mounting the accessory module to a panel of the light fixture, the clip comprising:

a body having top and bottom major surfaces;

a plurality of standoffs protruding from the top major surface, each of the standoffs including a support surface spaced above the top major surface of the clip;

a plurality of upper spring clips protruding above the top major surface, each of the upper spring clips including a column and a hook feature on the column, wherein the vertical distance between the support surfaces of the standoffs and the bottoms of the hook features of the upper spring clips is sized to accommodate the thickness of the printed circuit board of the accessory module such that the hook features of the upper spring clips engage edges of the printed circuit board of the accessory module and constrain the printed circuit board of the accessory module over the support surfaces; and a plurality of lower spring clips protruding below the bottom major surface of the clip, each of the lower spring clips including a column and a hook feature, wherein the vertical distance between the bottom major surface and the hook features of the lower spring clips is sized to accommodate the thickness of the panel of the light fixture, and wherein the lower spring clips engage the panel and constrain the clip to the panel.

2. The light fixture of claim 1, wherein the panel of the light fixture is a printed circuit board of the light fixture holding the one or more light sources.

3. The light fixture of claim 2, wherein the light sources are light emitting diodes (LEDs) arranged in two parallel rows, and wherein the clip is disposed between the two rows of LEDs.

4. The light fixture of claim 1, wherein the accessory module is a wireless communication module.

5. The light fixture of claim 4, wherein the light fixture further comprises a controller that receives communications through the wireless communication module, and that is configured to adjust the operation of the light fixture in response to the received communications.

6. The light fixture of claim 1, wherein the panel of the light fixture is a made of sheet metal.

7. The light fixture of claim 6, wherein the hook features of the lower spring clips engage edges of holes in the sheet metal panel.

8. The light fixture of claim 6, wherein the light sources are light emitting diodes (LEDs) arranged in at least one row on a printed circuit board of the light fixture, and wherein the clip is disposed adjacent to the printed circuit board of the light fixture holding the LEDs.

9. The light fixture of claim 1, wherein:

at least some of the standoffs are stepped standoffs, at least some of the stepped standoffs including a locating pin extending above the respective support surface; and the hook features of the upper spring clips engage edges of the printed circuit board of the accessory module and constrain the printed circuit board of the accessory module over the support surfaces while the locating pins protrude into holes in the printed circuit board of the accessory module.

10. The light fixture of claim 9, wherein the clip is a monolithic part molded from a polymer.

11. A method of assembling a light fixture, the method comprising:

providing a light fixture having a panel defining a plurality of openings;

providing an accessory module for the light fixture, the accessory module comprising circuit components mounted on a printed circuit board of the accessory module;

providing a clip comprising:

a body having top and bottom major surfaces;

a plurality of standoffs protruding from the top major surface, each of the standoffs including a support surface spaced above the top major surface of the clip;

a plurality of upper spring clips protruding above the top major surface, each of the upper spring clips including a column and a hook feature on the column, wherein the vertical distance between the support surfaces of the standoffs and the bottoms of the hook features of the upper spring clips is sized to accommodate the thickness of the printed circuit board of the accessory module such that the hook features of the upper spring clips engage edges of the printed circuit board of the accessory module and constrain the printed circuit board of the accessory module over the support surfaces; and a plurality of lower spring clips protruding below the bottom major surface of the clip, each of the lower spring clips including a column and a hook feature, wherein the vertical distance between the bottom major surface and the hook features of the lower spring clips is sized to accommodate the thickness of the panel of the light fixture, and wherein the lower spring clips engage the panel and constrain the clip to the panel;

snapping the printed circuit board of the accessory module into the clip; and snapping the clip into the panel.

12. The method of claim 11, wherein the standoffs are stepped standoffs, at least some of the stepped standoffs including a locating pin extending above the respective support surface, wherein snapping the printed circuit board of the accessory module into the clip comprises aligning holes in the printed circuit board of the accessory module over the locating pins.

13. A clip for mounting an accessory module to a panel of a light fixture, the clip comprising:

a body having top and bottom major surfaces;

a plurality of stepped standoffs protruding from the top major surface, each of the stepped standoffs including a support surface spaced above the top major surface of the clip, and at least some of the plurality of stepped standoffs including a locating pin extending above the respective support surface;

a plurality of upper spring clips protruding above the top major surface, each of the upper spring clips including a column and a hook feature on the column, wherein the vertical distance between the support surfaces of the standoffs and the bottoms of the hook features of the upper spring clips is sized to accommodate the thickness of a printed circuit board of the accessory module such that the hook features of the upper spring clips are configured to engage edges of the printed circuit board of the accessory module and constrain the printed circuit board of the accessory module over the support surfaces while the locating pins protrude into holes in the printed circuit board of the accessory module; and a plurality of lower spring clips protruding below the bottom major surface of the clip, each of the lower spring clips including a column and a hook feature, wherein the vertical distance between the bottom major surface and the hook features of the lower spring clips is sized to accommodate the thickness of the panel of the light fixture, and wherein the lower spring clips are configured to engage the panel and constrain the clip to the panel.

14. The clip of claim 13, wherein the clip is a monolithic part molded from a polymer.

15. The clip of claim 13, wherein the sum of the thickness of the body and the height of the support surfaces above the top major surface is at least 2.5 millimeters.

16. The clip of claim 13, wherein the sum of the thickness of the body and the height of the support surfaces above the top major surface is at least 3.0 millimeters.

17. The clip of claim 13, in combination with the accessory module.

18. The clip of claim 13, mounted to the panel of the light fixture.

* * * * *